US005084432A

United States Patent [19]

Higashiyama

[11] Patent Number: 5,084,432

[45] Date of Patent: Jan. 28, 1992

[54] DEVELOPER SHEET FOR ORNAMENTAL USE

[75] Inventor: Shunichi Higashiyama, Yokkaichi, Japan

[73] Assignee: Brother Kogyo Kabushiki Kaisha, Nagoya, Japan

[21] Appl. No.: 552,568

[22] Filed: Jul. 3, 1990

[30] Foreign Application Priority Data

Aug. 7, 1989 [JP] Japan ..... 1-92638[U]

[51] Int. Cl.[5] ..... B41M 5/40

[52] U.S. Cl. ..... 503/200; 427/152; 503/216; 503/225; 503/226

[58] Field of Search ..... 503/200, 226, 216, 225; 427/152

[56] References Cited

FOREIGN PATENT DOCUMENTS 73046 6/1977 Japan ..... 503/200
1097679 4/1989 Japan ..... 503/200

*Primary Examiner*—Pamela R. Schwartz
*Attorney, Agent, or Firm*—Oliff & Berridge

[57] ABSTRACT

A developer sheet is composed, in one embodiment, of a reflecting layer formed by securely bonding an aluminum or other metal foil on a substrate and a developer layer formed on the reflecting layer. The developer sheet is capable of forming a color picture image on the reflecting layer, producing ornamental or decorative effects with high commercial value.

19 Claims, 3 Drawing Sheets

DEVELOPER SHEET FOR ORNAMENTAL USE

BACKGROUND OF THE INVENTION

1. Field of the Invention

This invention relates to a developer sheet bearing a color developer reactive with a dye precursor contained in microcapsules of a photo-, thermo- and/or pressure-sensitive recording medium, ad more particularly to a developer sheet particularly suitable for ornamental or decorative use.

2. Description of the Related Art

It has thus far been known in the art to provide recording media consisting of a combination of a sheet which is coated with microcapsules containing a photohardening resin, a photo-polymerization initiator and a dye precursor as major constituents, and a sheet which is coated with a developing agent capable of developing a color image by reaction with the encapsulated dye precursor, as described in Japanese Laid-Open Patent Applications 58-88739, 58-88740, 61-42649 and 61-24495.

Since the mechanical strength of the microcapsules is increased upon exposure to light because of the photohardening substance, the recording media of this sort have been used mainly on a machine which is arranged to expose a microcapsule-coated surface to light according to picture image information and then to rupture or crush the unhardened microcapsules, forming a picture image by reaction of the developing agent on the developer sheet with the dye precursor released from the ruptured microcapsules.

The developer sheets may be classified into a paper type which carries a developer layer on a substrate paper sheet and a plastic type which carries a developer layer on a transparent plastic film for overhead projectors.

The existing developer sheets are designed only for use as print-out sheets or for use on overhead projectors, giving no consideration to the use of developer sheets for ornamental or decorative purposes.

SUMMARY OF THE INVENTION

The present invention contemplates elimination of the above-mentioned deficiency of existing developer sheets and has as its object the provision of a developer sheet which has high ornamental or decorative characteristics along with a high commercial value.

In accordance with an aspect of the present invention, there is provided a developer sheet which is composed of a developer layer formed on a substrate and containing as a major component at least a developing agent capable of developing a color image by reaction with a dye precursor, and a reflecting layer formed by the substrate itself or formed on the front or rear side of the substrate.

The developer sheet of the invention, which has a reflecting layer on the front or back side of the substrate as described above, can form a highly decorative and reflective picture image on the sheet. Accordingly, the developer sheet of the invention is capable of not only forming a beautiful picture image but also imparting a high commercial value by the reflecting layer.

The above and other objects, features and advantages of the invention will be more fully understood from the following particular description of the invention, taken in conjunction with the accompanying drawings which are for the purpose of illustration only and do not limit the invention.

DESCRIPTION OF THE PREFERRED EMBODIMENTS

Figure 1:
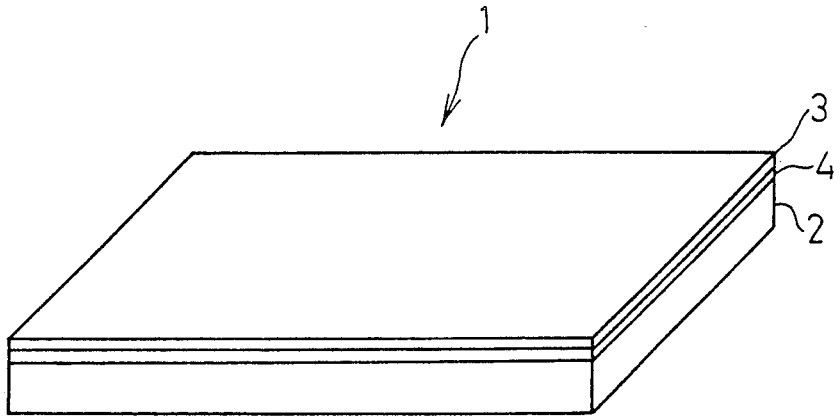
FIG. 1 is a perspective view of a developer sheet embodying the present invention.

Hereafter, the invention is described particularly by way of the embodiment shown in the drawings.

Referring to FIG. 1, there is schematically shown an embodiment of a developer sheet according to the invention. The developer sheet 1 is provided with a substrate 2 of 127.9 g/m$^2$ white high grade paper and a reflecting layer of 15 μm thick aluminum foil 4 pressed on the substrate by the use of a smoothing roller (with a roll diameter of 100 mm and a linear pressure of 2 kg/mm) warmed to 150° C. after applying 30 wt % aqueous dispersion of ionomer as an adhesive at a rate of 10 g/m$^2$.

Formed on the aluminum foil 4 is a developer layer 3 of a developing agent, which is formed, for example, by dispersing 30 parts of zinc 3,5-ditertiary butyl-4-hydroxybenzoate, 30 parts of zinc salicylate, 30 parts of bisphenol A and 30 parts of p-phenylphenol in a binder consisting of 600 parts of aqueous solution of polyvinyl alcohol, and coating the developer on the aluminum foil 4 with a #20 bar coater (as specified in JIS K 5400), followed by drying at 90° C.

The developer layer 3 may employ almost any of other developing agents which have thus far been used for developer sheets. For example, there may be employed an inorganic acidic substance such as activated clay or kaolin, an aromatic carboxylic acid compound such as phenol resin, salicylic acid, gallic acid or propyltannic acid, which may be used singly or in combination. However, in order to produce the effects of the reflecting layer to a sufficient degree, it is desirable to use a thermally fusible developer or developers. A binder, filler, adhesive, thermoplastic resin or other additives may be mixed into the developer layer 3 in a desired proportion as well.

The reflecting layer 4 is not restricted to an aluminum foil as employed in the above-described embodiment, and may be of any material having a shiny, brilliant reflective appearance. Other suitable materials include a foil of other metal such as tin, nickel, copper, gold or the like, a coating of metal powder admixed with an adhesive or a vacuum evaporated layer of a metal. "Light reflecting layer" as used herein, including the claims, refers to a layer exhibiting a brilliant or shiny appearance, i.e., having a surface which is at least partially image reflective.

Figure 2:
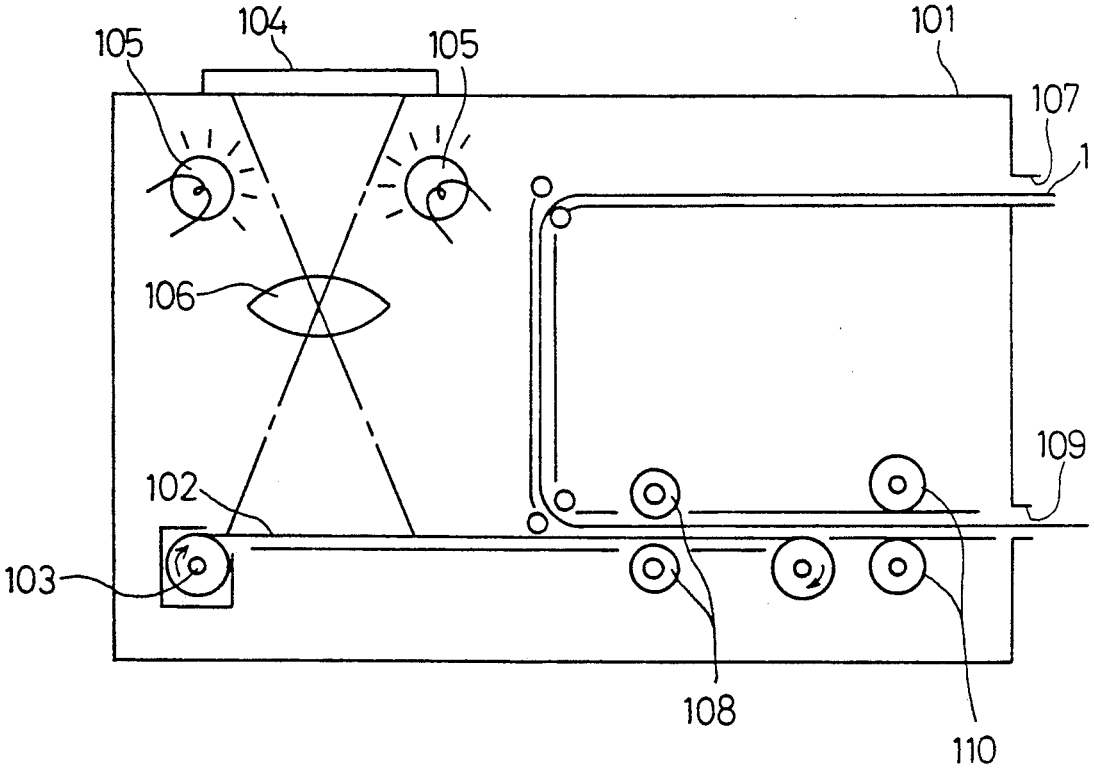
FIG. 2 is a schematic illustration of an image recording apparatus employing the developer sheet of the invention.

Schematically illustrated in FIG. 2 is an image recording machine employing the developer sheet according to the present invention, which is provided with a sheet feed roller 103 within a housing 101 for supporting a roll of photo-sensitive and pressure-sensitive sheet 102 carrying microcapsules thereon. The photo-sensitive and pressure-sensitive sheet 102 which is unreeled from the sheet feed roller 103 is fed in the arrowed direction. Located on one side of the path of travel of the photo-sensitive and pressure-sensitive sheet 102 is exposure means which effects a predetermined exposure process on the front surface of the sheet 102, the exposure means including a light source 105 for irradiating the surface of an original 104 and an optical lens 106 for forming an image on the surface of the photo-sensitive and pressure-sensitive sheet 102. The machine is further provided with a slit 107 for insertion of a developer sheet 1 as the developer medium according to the present invention. The developer sheet 1 is overlapped on the exposed photo-sensitive and pressure-sensitive sheet 102 and passed successively through a pressing developing means in the form of press rollers 108 and a heating means in the form of hot rollers 110. The developer sheet 1 is discharged from the machine through an outlet 109 which is provided separately from the inlet slit 107.

Following is the sequence of the operation performed by the image forming machine of the above-described arrangement.

The light reflected from the original 104, which is irradiated by the light source 105, is passed through the lens 106 to form an image on the photo-sensitive and pressure-sensitive sheet 102, exposing the same according to the image of the original 104. The developer sheet 1 which has been set in a predetermined position is inserted into the machine through the inlet slit 107 and fed forward to join the photo-sensitive and pressure-sensitive sheet 102 in overlapping relation therewith. The overlapped sheets are pressed through the press rollers 108 to squeeze the dye precursor out of the microcapsules in unexposed portions of the photo-sensitive and pressure-sensitive sheet 102, developing an image on the developer sheet 1 by reaction with the developing agent on the sheet 1. The developer sheet 1 is then heated through the heat rollers 110, thereby melting the thermally fusible developing agent to increase the transparency of the developer layer before discharging the same through the outlet 109.

In this matter, the developer sheet 1 which has the image of the original transferred on its surface is produced for ornamental use. Typically, the reflective layer is not visible at a position of the image. Rather, the ornamental effect arises from the areas of the developer sheet surrounding the transferred image where the reflective layer is visible through the substantially transparent developer layer.

Figure 3:
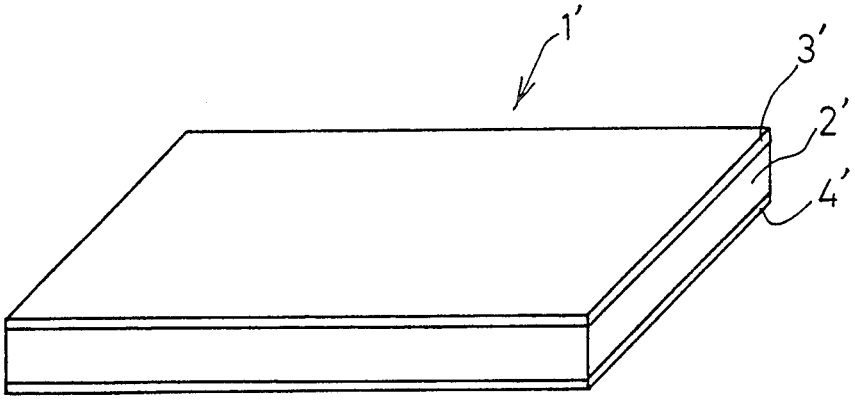
FIG. 3 is a perspective view of a developer sheet representing an alternative embodiment of the present invention.

FIG. 3 illustrates an alternative embodiment of the invention, wherein the reflecting layer 4' is pressed on the back side of a suitable transparent substrate 2' (e.g., overhead projector sheet) and the developer layer 3' is provided on a front side of the substrate 2'. Effects achieved with this embodiment are similar to those in the first embodiment.

Some examples of applications of the present invention are now described:

(A) Use as a sticker

The developer sheet prepared by the invention can be used as sticker, e.g., for traffic markers such as a road sign, highway marker, caution marker adhered to children's cloths and the like. Because of high light-reflectability of the developer sheet, the sheet can call the attention of drivers, passengers, etc. to potential hazards. As a result, traffic accidents can be reduced.

(B) Use in a catalog

The developer sheet can be used for catalogs with beautiful images thereon, i.e., with high ornamental effects.

(C) Use as a work of art

By copying a landscape or portrait on the developer sheet, the sheet can be used itself as a work of art.

While the invention has been particularly shown and described by way of preferred embodiments thereof, it is to be understood that it is possible for those skilled in the art to add thereto various alterations and modifications in form and details without departing from the spirit and scope of the invention as encompassed by the appended claims.

What is claimed is:

1. A developer sheet for ornamental use comprising:
a base sheet;
a light reflecting layer formed on one side of the base sheet, said light reflecting layer having a shiny brilliant reflective appearance; and
a developer layer formed on an outer surface of the light reflecting layer, the developer layer being capable of forming a color image on the developer sheet by reaction with a dye-precursor such that said light reflecting layer is visible through the developer layer where the color image is not formed.

2. A developer sheet according to claim 1, wherein the base sheet is opaque.

3. A developer sheet according to claim 2, wherein the base sheet is a paper sheet.

4. A developer sheet according to claim 1, wherein the light reflecting layer is a metal foil adhered to the one side of the base sheet.

5. A developer sheet according to claim 4, wherein the metal foil is made of a metal selected from the group consisting of aluminum, tin, nickel, copper, silver and gold.

6. A developer sheet according to claim 1, wherein the light reflecting layer is formed by coating a mixture of a metal powder and an adhesive on the one side of the base sheet.

7. A developer sheet according to claim 1, wherein the light reflecting layer is a metal layer formed by vacuum evaporation of the metal.

8. A developer sheet according to claim 1, wherein the developer layer is a coating of one or more materials selected from the group consisting of activated clay, inorganic acidic substance and aromatic carboxylic acid compound.

9. A method for producing a developer sheet for ornamental use comprising the steps of:
providing a base sheet;
forming a light reflecting layer on one side of the base sheet, said light reflecting layer having a shiny brilliant reflective appearance; and
forming a developer layer on an outer surface of the light reflecting layer, the developer layer being capable of forming a color image on the developer sheet by reaction with a dye-precursor such that said light reflecting layer is visible through the developer layer where the color image is not formed.

10. A method according to claim 9, wherein the light reflective layer is formed by adhering a metal foil to the one side of the base sheet.

11. A method according to claim 10, wherein the developer layer is formed by coating a developing agent on the metal foil and drying the agent.

12. An ornamental sheet comprising:

a base sheet;

a light reflecting layer formed by adhering a metal foil to one side of the base sheet, said light reflecting layer having a shiny, brilliant reflective appearance; and an image forming layer on the light reflecting layer, the image forming layer having an image formed by reaction between a developer agent and a dye-precursor that said light reflecting layer is visible through the image forming layer where the color image is not formed.

13. A developer sheet product for ornamental use comprising:

a base sheet with a light reflecting layer having a shiny, brilliant reflective appearance and developer layer carried thereon, wherein a color image is formed on a portion of the developer layer by reaction with a dye precursor and the light reflecting layer is visible through the developer layer where the color image is not formed, so as to create an ornamental effect.

14. A developer sheet product according to claim 13, wherein the light reflecting layer is formed directly on the base sheet and the developer layer is formed directly on the light reflecting layer.

15. A developer sheet product according to claim 13, wherein the base sheet is transparent and the light reflecting layer and developer layer are formed directly on opposite sides of the base sheet.

16. A method for producing a developer sheet product for ornamental use comprising the steps of:

providing a base sheet having a light reflecting layer, said light reflecting layer having a shiny, brilliant reflective appearance, and a developer layer carried thereon; and forming an image on a portion of the developer by reacting the developer layer with a dye-precursor, such that the light reflecting layer is visible through the developer layer where the color image is not formed, so as to create an ornamental effect.

17. A method according to claim 16, wherein the light reflecting layer is formed directly on said base sheet and said developer layer is formed directly on said light reflecting layer.

18. A method according to claim 16, wherein the base sheet is transparent and the light reflecting layer and developer layer are formed directly on opposite sides of the base sheet.

19. A developer sheet for ornamental use comprising:

a transparent base sheet;

a light reflecting layer formed on one side of the transparent base sheet, said light reflecting layer having a shiny, brilliant reflective appearance; and a developer layer formed on a side of the transparent base sheet opposite said one side, the developer layer being capable of forming a color image on the base sheet by reaction with a dye-precursor such that the light reflecting layer is visible through the developer layer where the color image is not formed.

* * * * *